US012638193B2

(12) United States Patent
Do et al.

(10) Patent No.: US 12,638,193 B2
(45) Date of Patent: May 26, 2026

(54) HOT WATER SUPPLY APPARATUS AND METHOD OF CONTROLLING THE SAME

(71) Applicant: KYUNGDONG NAVIEN CO., LTD., Pyeongtaek-si (KR)

(72) Inventors: Nam Soo Do, Seoul (KR); Yong Min Song, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 230 days.

(21) Appl. No.: 18/387,355

(22) Filed: Nov. 6, 2023

(65) Prior Publication Data

US 2024/0159401 A1 May 16, 2024

(30) Foreign Application Priority Data

Nov. 11, 2022 (KR) ..... 10-2022-0150285

(51) Int. Cl.
*F24D 19/10* (2006.01)
*F04B 49/02* (2006.01)
*F04B 51/00* (2006.01)

(52) U.S. Cl.
CPC ..... *F24D 19/1051* (2013.01); *F04B 49/02* (2013.01); *F04B 51/00* (2013.01)

(58) Field of Classification Search
CPC ..... F24D 19/1051; F04B 49/02
See application file for complete search history.

(56) References Cited

U.S. PATENT DOCUMENTS 4,936,289 A * 6/1990 Peterson ..... F24D 19/1051 122/13.3
10,648,680 B2 * 5/2020 Heo ..... F24D 17/0078
2009/0145490 A1 * 6/2009 Kershisnik ..... E03B 7/04 137/334
2016/0186415 A1 6/2016 Yuge
2020/0271356 A1 8/2020 Hasegawa
2020/0386418 A1 * 12/2020 Choi ..... F24D 19/1069
2021/0190377 A1 6/2021 Heo et al.

FOREIGN PATENT DOCUMENTS

JP 2016125692 A 7/2016
JP 2020139633 A 9/2020
KR 20210081897 A 7/2021
WO 2005057086 A1 6/2005

OTHER PUBLICATIONS

Search and Examination Report received in GB application No. 2317024.4 on Apr. 11, 2024.
Office Action received in Korean Patent Application No. 10-2022-0150285 on Mar. 17, 2025.

* cited by examiner

*Primary Examiner* — Kevin F Murphy
(74) *Attorney, Agent, or Firm* — ALG Intellectual Property, LLC

(57) ABSTRACT

A hot water supply apparatus according to an embodiment of the present disclosure includes a pump that applies a pressure to a direct water supply line connected to a heat exchanger to supply direct water or hot water to the heat exchanger, a flow rate sensor that measures a flow rate of the direct water or the hot water flowing through the direct water supply line, and a controller that maintains an operating state of the pump during a reference time and confirms a change in a flow rate of the direct water supply line through the flow rate sensor when use of the hot water is stopped while the hot water is used in a state in which the pump is in operation.

15 Claims, 7 Drawing Sheets

HOT WATER SUPPLY APPARATUS AND METHOD OF CONTROLLING THE SAME

CROSS-REFERENCE TO RELATED APPLICATION

This application claims the benefit of priority to Korean Patent Application No. 10-2022-0150285, filed in the Korean Intellectual Property Office on Nov. 11, 2022, the entire contents of which are incorporated herein by reference.

TECHNICAL FIELD

The present disclosure relates to a hot water supply apparatus and a method of controlling the same.

BACKGROUND

In general, a hot water supply apparatus is an apparatus that heats cold water to a predetermined temperature and supplies the heated water so that a user may conveniently use hot water.

This hot water supply apparatus shortens a time for which the hot water reaches a target temperature by performing a turbo hot water function to supply the hot water corresponding to the target temperature within a short period of time after the user opens a faucet.

When the turbo hot water function is controlled, the hot water supply apparatus detects a change in a flow rate of the hot water when the user opens the faucet and uses the hot water. In this case, when the detected change in the flow rate of the hot water is maintained for a predetermined period of time, for example, five seconds, a circulation pump is operated to increase the flow rate of the hot water.

In a hot water supply apparatus according to the related art, when the supply of the hot water is stopped by temporarily turning off the faucet because the user uses soap, the pump stops operating, the hot water function is terminated, and thus a temperature of the hot water decreases. Thus, when the user opens the faucet to use the hot water again within a predetermined time, the hot water supply apparatus detects the change in the flow rate of the hot water again, and when the detected change in the flow rate of the hot water is maintained for, for example, five seconds, the circulation pump is operated to increase the flow rate of the hot water and thus supplies the hot water to the user.

However, even when the user stops using of the hot water for a short period of time, a time is taken for which the temperature of the hot water supplied when the hot water is used next reaches the target temperature.

SUMMARY

The present disclosure has been made to solve the above-mentioned problems occurring in the prior art while advantages achieved by the prior art are maintained intact.

An aspect of the present disclosure provides a hot water supply apparatus in which, when use of hot water is stopped in a state in which the hot water supply apparatus is set to a turbo hot water function, operation of a pump is not immediately stopped, a pump operating state is maintained during a reference time, and thus when the hot water is reused within the reference time, a temperature of the existing hot water is maintained, and a method of controlling the same.

Another aspect of the present disclosure provides a hot water supply apparatus in which a flow rate of a direct water supply line is confirmed in real time while the hot water is used in a state in which the hot water supply apparatus is set to the turbo hot water function, and when a difference between an instantaneous decrease flow rate of the direct water supply line and a reference average flow rate value is greater than or equal to a reference value, it is determined that the use of the hot water is stopped, and thus unnecessary preheating is prevented from continuing, and a method of controlling the same.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a hot water supply apparatus includes a pump that applies a pressure to a direct water supply line connected to a heat exchanger to supply direct water or hot water to the heat exchanger, a flow rate sensor that measures a flow rate of the direct water or the hot water flowing through the direct water supply line, and a controller that maintains an operating state of the pump during a reference time and confirms a change in a flow rate of the direct water supply line through the flow rate sensor when use of the hot water is stopped while the hot water is used in a state in which the pump is in operation.

In an embodiment, the controller may determine that the use of the hot water is stopped when the flow rate confirmed through the flow rate sensor decreases by a preset reference amount or more.

In an embodiment, the controller may monitor the flow rate measured by the flow rate sensor every time while the hot water is used in a state in which the pump is in operation and determine whether a hot water use stopping condition is satisfied.

In an embodiment, the controller may compare an instantaneous decrease flow rate confirmed through the flow rate sensor with a reference average flow rate value and determine that the hot water use stopping condition is satisfied when a difference value therebetween is greater than or equal to a preset reference value.

In an embodiment, the controller may confirm an average flow rate value for previous time T whenever time T elapses and define, as the reference average flow rate value, a larger value of two recently confirmed average flow rate values based on a time point at which the instantaneous decrease flow rate is confirmed.

In an embodiment, the controller may stop the operation of the pump when the flow rate confirmed through the flow rate sensor does not increase to a preset reference amount or more until the reference time elapses after the use of the hot water is stopped.

In an embodiment, the controller may determine that the hot water supply apparatus is in a hot water reuse state when the flow rate confirmed through the flow rate sensor increases to a preset reference amount or more before the reference time elapses after the use of the hot water is stopped.

In an embodiment, the hot water supply apparatus may further include a direct water temperature sensor that is disposed in the direct water supply line and measures a temperature of the direct water or the hot water flowing through the direct water supply line.

In an embodiment, the controller may stop the operation of the pump when it is confirmed that the temperature of the direct water or the hot water confirmed by the direct water temperature sensor is greater than or equal to a predetermined temperature.

The controller may operate the hot water supply apparatus in a turbo hot water mode when the flow rate confirmed by the flow rate sensor increases to a preset reference amount or more in a state in which a turbo hot water function is set to an ON state.

According to another aspect of the present disclosure, a method of controlling a hot water supply apparatus includes applying, by a pump, a pressure to a direct water supply line connected to a heat exchanger to supply direct water or hot water to the heat exchanger, measuring, by a flow rate sensor, a flow rate of the direct water or the hot water flowing through the direct water supply line, and confirming a change in the flow rate of the direct water supply line through the flow rate sensor while an operating state of the pump is maintained during a reference time when use of the hot water is stopped while the hot water is used in a state in which the pump is in operation.

In an embodiment, the confirming of the change in the flow rate may include determining that the use of the hot water is stopped when the flow rate confirmed through the flow rate sensor decreases by a preset reference amount or more.

In an embodiment, the method may further include monitoring the flow rate measured by the flow rate sensor every time until the reference time elapses while the hot water is used in a state in which the pump is in operation, and determining whether a hot water use stopping condition is satisfied based on the flow rate confirmed from the flow rate sensor.

In an embodiment, the determining of whether the hot water use stopping condition is satisfied may include confirming an average flow rate value for previous time T whenever time T elapses, defining, as a reference average flow rate value, a larger value of two recently confirmed average flow rate values based on a time point at which an instantaneous decrease flow rate is confirmed when the flow rate decreases, and comparing the instantaneous decrease flow rate with the reference average flow rate value and determining that the hot water use stopping condition is satisfied when a difference value therebetween is greater than or equal to a preset reference value.

In an embodiment, the method may further include stopping the operation of the pump when the flow rate confirmed through the flow rate sensor does not increase to a preset reference amount or more until the reference time elapses after the use of the hot water is stopped.

In an embodiment, the method may further include determining that the hot water supply apparatus is in a hot water reuse state when the flow rate confirmed through the flow rate sensor increases to a preset reference amount or more before the reference time elapses after the use of the hot water is stopped.

In an embodiment, the method may further include measuring a temperature of the direct water or the hot water flowing through the direct water supply line using a direct water temperature sensor disposed in the direct water supply line.

In an embodiment, the method may further include stopping the operation of the pump when it is confirmed that the temperature of the direct water or the hot water confirmed by the direct water temperature sensor is greater than or equal to a predetermined temperature.

In an embodiment, the method may further include operating the hot water supply apparatus in a turbo hot water mode when the flow rate confirmed by the flow rate sensor increases to a preset reference amount or more in a state in which a turbo hot water function is set to an ON state.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
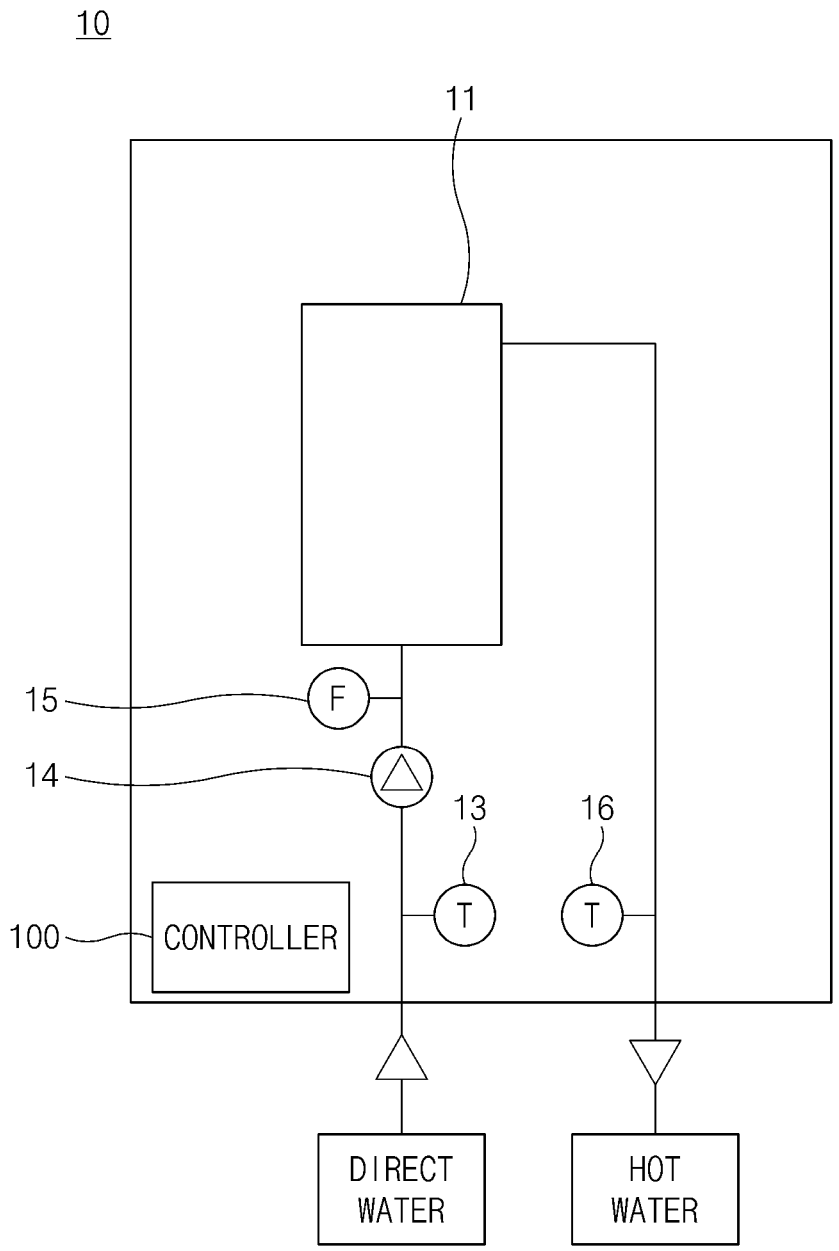
FIG. 1 is a view illustrating a configuration of a hot water supply apparatus according to an embodiment of the present disclosure.

Hereinafter, some embodiments of the present disclosure will be described in detail with reference to the exemplary drawings. In adding reference numerals to components of each drawing, it should be noted that identical or equivalent components are designated by an identical numeral even when they are displayed on other drawings. Further, in describing the embodiment of the present disclosure, a detailed description of the related known configuration or function will be omitted when it is determined that it interferes with the understanding of the embodiment of the present disclosure.

In describing the components of the embodiment according to the present disclosure, terms such as first, second, A, B, (a), (b), and the like may be used. These terms are merely intended to distinguish one component from other components, and the terms do not limit the nature, order, or sequence of the components. Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
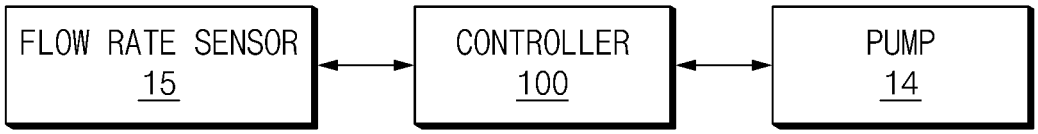
FIG. 2 is a view illustrating a control structure of the hot water supply apparatus according to the embodiment of the present disclosure.

FIG. 1 is a view illustrating a hot water supply apparatus according to an embodiment of the present disclosure, and FIG. 2 is a view illustrating a control structure of the hot water supply apparatus according to the embodiment of the present disclosure.

First, referring to FIG. 1, a hot water supply apparatus 10 may correspond to an electric boiler or a water heater that stores and heats water.

Accordingly, the hot water supply apparatus 10 may include a heat exchanger 11, a direct water temperature sensor 13, a pump 14, a flow rate sensor 15, and a hot water temperature sensor 16.

Further, the hot water supply apparatus 10 may further include a controller 100 that performs overall functions related to supply of hot water. The controller 100 may control operations of the heat exchanger 11, the direct water temperature sensor 13, the pump 14, the flow rate sensor 15, and the hot water temperature sensor 16. Here, the controller 100 may be a hardware device such as a processor or a central processing unit (CPU) or a program implemented by the processor.

The heat exchanger 11 may generate the hot water from direct water having the room temperature supplied through a direct water supply line by exchanging heat with the direct water and may discharge the generated hot water to a hot water discharge line.

The direct water temperature sensor 13, which is a sensor for measuring a temperature of the direct water or the hot water supplied to the heat exchanger 11, may be provided in the direct water supply line.

Further, the pump 14 may be further provided in the direct water supply line. The pump 14 serves to increase a flow rate of the direct water flowing into the heat exchanger 11 by applying a pressure to the direct water supply line. Further, the pump 14 serves to supply the hot water remaining in the hot water discharge line back to the heat exchanger 11. In this case, when the hot water flows into the direct water supply line, the pump 14 supplies the hot water flowing into the direct water supply line to the heat exchanger 11 so that the hot water recirculates. In this case, as the hot water recirculates, the direct water or hot water flowing into the heat exchanger 11 through the direct water supply line may be preheated.

A line for recirculation of the hot water remaining in the hot water discharge line may be separately provided between the direct water supply line and the hot water discharge line.

The flow rate sensor 15 is a sensor for measuring the flow rate of the direct water or the hot water flowing through the direct water supply line. The flow rate sensor 15 may continuously measure the flow rate of the direct water or the hot water flowing through the direct water supply line in predetermined time units while the hot water supply apparatus 10 operates in a hot water mode. As an example, the flow rate sensor 15 may measure the flow rate of the direct water supply line every second.

In this case, the flow rate sensor 15 transmits information on the measured flow rate of the direct water supply line to the controller 100. Thus, the controller 100 may control a hot water supply operation while confirming the flow rate of the direct water supply line transmitted from the flow rate sensor 15 in real time.

Further, the hot water temperature sensor 16 for measuring a temperature of the discharged hot water may be further provided in the hot water discharge line.

The embodiment of FIG. 2 is referenced as a specific situation in which the controller 100 controls the hot water supply operation.

Referring to FIG. 2, when a hot water switch is operated by the user, the controller 100 sets a hot water function to an ON state. Further, when a turbo hot water switch is operated by the user, the controller 100 may set a turbo hot water function to an ON state. The turbo hot water function refers to a function of driving the pump 14 to increase the flow rate by a certain amount so as to supply the hot water within a short time. According to the embodiment, the turbo hot water function may be performed only for a predetermined time from a time point when the corresponding function is turned on.

In the hot water supply apparatus 10, in a state in which the hot water function (or the turbo hot water function) is set to the ON state, when the faucet is opened by the user and thus a current state is switched to a hot water usage state, as the hot water is discharged to the faucet through the hot water discharge line, the flow rate detected by the flow rate sensor 15 provided in the direct water supply line increases.

Accordingly, the controller 100 allows the hot water supply apparatus 10 to operate in the hot water mode when the flow rate detected by the flow rate sensor 15 increases to a certain amount or more, for example, a first reference amount or more. In this case, the controller 100 controls operations of a heater, the heat exchanger 11, the pump 14, and sensors to supply hot water. Thus, the hot water may be generated by the heat exchanger 11, and in this case, the generated hot water may be supplied through the hot water discharge line.

When the turbo hot water function is set to the ON state, the controller 100 allows the hot water supply apparatus 10 to operate in a turbo hot water mode when the supply of the hot water is maintained for a predetermined time or more. In this case, the controller 100 operates the pump 14 to increase the flow rate supplied to the heat exchanger 11, so that a large amount of hot water may be supplied in a short period of time.

The controller 100 confirms whether the flow rate of the direct water supply line decreases while continuously confirming a measured value of the flow rate sensor 15 while the hot water is used with the pump 14 operating in the turbo hot water mode. In this case, when the flow rate of the direct water supply line confirmed while the hot water is used decreases by a second reference amount or more, the controller 100 may determine that the use of the hot water is stopped.

When the use of the hot water is stopped in a state in which the pump 14 is in operation, the controller 100 maintains the pump 14 for circulation of the hot water in an operating state for a reference time to maintain the temperature of the hot water when the hot water supply apparatus 10 is switched to a hot water reuse state within a predetermined time.

Figure 3:
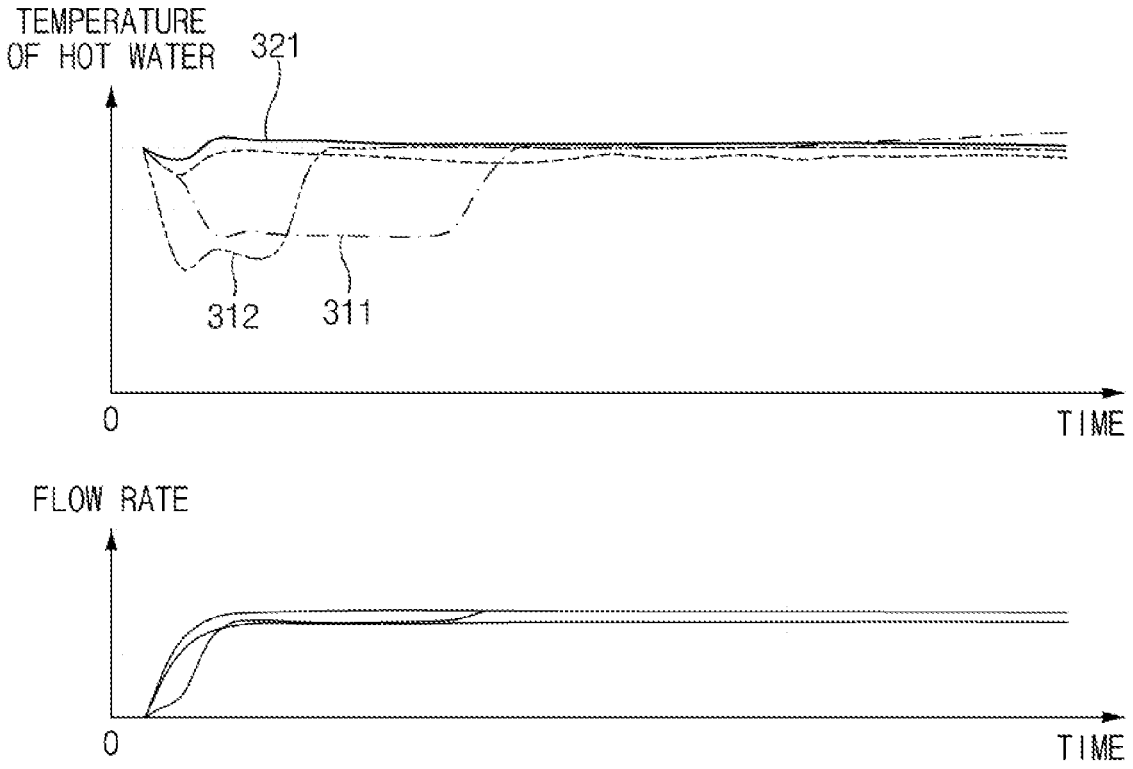
FIG. 3 is a view referenced to describe a change in a flow rate and temperature of hot water according to the embodiment of the present disclosure.

FIG. 3 is a view referenced to describe a change in the flow rate and temperature of the hot water according to the embodiment of the present disclosure and illustrates a hot water temperature and flow rate change graph according to each situation when the hot water is reused after the use of the hot water is stopped.

Referring to FIG. 3, reference numeral 311 is a temperature change graph according to general hot water use and illustrates a hot water temperature change generally when the pump 14 is stopped when the use of the hot water is stopped and the pump 14 is operated after a predetermined time when the flow rate of the direct water supply line increases. In this case, when the hot water is reused, as the pump 14 is operated after a predetermined time, the temperature of the hot water temporarily decreases, and thus some time is taken until the temperature of the hot water reaches a target temperature.

Reference numeral 312 indicates a change in the temperature of the hot water when the pump 14 is stopped when the use of the hot water is stopped and the pump 14 is immediately operated when the flow rate of the direct water supply line increases. In this case, as the pump 14 is operated immediately after the hot water is reused, the temperature of the hot water reaches the target temperature faster than the graph of reference numeral 311. However, the temperature of the hot water temporarily decreases due to an increase in the flow rate caused by operating the pump 14, and thus a predetermined amount of time is taken until the temperature of the hot water reaches the target temperature.

Meanwhile, reference numeral 321 indicates the change in the temperature of the hot water when the pump 14 is maintained in operation even when the use of the hot water is stopped. In this case, even when the use of the hot water is stopped, as the pump 14 is maintained in operation, the hot water recirculates to maintain the temperature of the hot water, and when the hot water is reused, the hot water having the target temperature may be immediately supplied.

In this case, after the use of the hot water is stopped, the controller 100 confirms the flow rate of the direct water supply line, which is measured by the flow rate sensor 15 at a set time, for example, every second, while the pump 14 is maintained in operation.

When the flow rate of the direct water supply line does not increase to the first reference amount or more even when a reference time elapses after the use of the hot water is stopped, the controller 100 determines that the hot water is not reused, and thus stops the operation of the pump 14, and terminates the hot water mode.

Meanwhile, when it is confirmed that the flow rate confirmed from the flow rate sensor 15 increases to the first reference amount or more before the reference time elapses after the use of the hot water is stopped, the controller 100 determines that the current state is the hot water reuse state, controls the hot water function again, and supplies the hot water.

Further, even while the hot water is used while the pump 14 is in operation, the controller 100 may monitor the flow rate of the direct water supply line to confirm whether a hot water use stopping condition is satisfied.

In other words, the controller 100 confirms the flow rate of the direct water supply line through the flow rate sensor 15 at a set time, for example, every second, while the hot water is used in a state in which the pump 14 is in operation and confirms an average flow rate value of the flow rate of the direct water supply line during time "T" whenever time "T" elapses. As an example, the controller 100 may confirm the average flow rate value of the flow rate of the direct water supply line every two seconds.

When it is confirmed by the flow rate sensor 15 that the flow rate decreases while the hot water is used, the controller 100 compares an instantaneous decrease flow rate confirmed by the flow rate sensor 15 with a reference average flow rate value. Here, the reference average flow rate value may be defined as a larger value of two recently confirmed average flow rate values based on a time point when the instantaneous decrease flow rate is confirmed.

Figure 4:
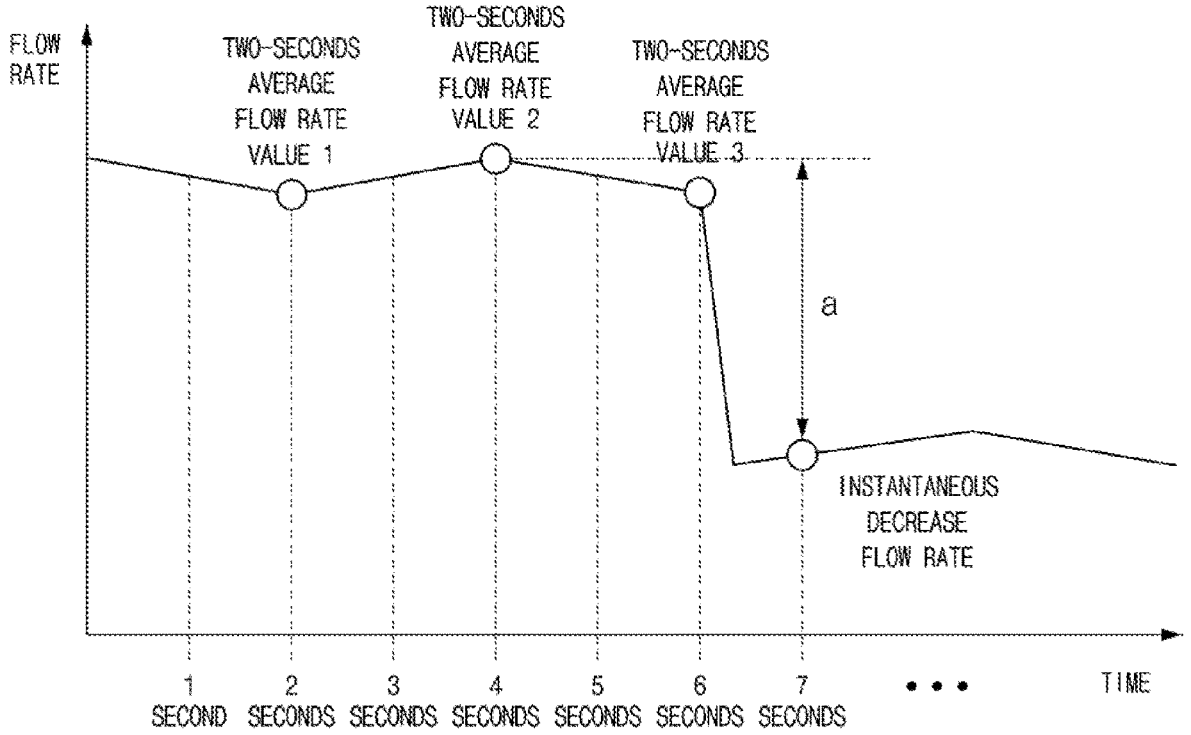
FIG. 4 is a view referenced to describe an operation of determining a hot water use stopping condition of the hot water supply apparatus according to the embodiment of the present disclosure.

An embodiment in which the instantaneous decrease flow rate and the reference average flow rate value are compared with each other refers to FIG. 4.

Referring to FIG. 4, the controller 100 confirms the flow rate of the hot water every second while the hot water is used and confirms an average flow rate value 1 after two seconds, confirms an average flow rate value 2 after four seconds, and confirms an average flow rate value 3 after six seconds. In this way, the controller 100 may confirm the average flow rate value every two seconds. In an embodiment of FIG. 4, it is illustrated that the average flow rate value is confirmed every two seconds, but a time unit for confirming the average flow rate value may change according to settings.

When the flow rate decreases after six seconds, the controller 100 confirms the instantaneous decrease flow rate at seven seconds and defines, as the reference average flow rate value, the average flow rate value 2 that is a larger value of the two recently confirmed average flow rate values 2 and 3 with respect to seven seconds.

In this case, the controller 100 compares the instantaneous decrease flow rate confirmed at seven seconds with the reference average flow rate value, that is, the average flow rate value 2 and determines that the hot water use stopping condition is satisfied when a difference value "a" therebetween is greater than or equal to a reference value (e.g., 1.0 LPM).

When it is confirmed that the hot water use stopping condition is satisfied while the hot water is used in a state in which the pump 14 is in operation, the controller 100 determines that the current state is a hot water use stopping state and maintains the operation of the pump 14 for a reference time, and when the flow rate of the direct water supply line does not increase to the first reference amount even when the reference time elapses, the controller 100 determines that the hot water is not reused and stops the operation of the pump 14.

Of course, when the flow rate confirmed through the flow rate sensor 15 before the reference time elapses increases to a preset reference amount or more, the controller 100 determines that the current state is the hot water reuse state, controls the hot water function again, and supplies the hot water.

Meanwhile, the controller 100 confirms the temperature of the direct water or hot water flowing through the direct water supply line by the direct water temperature sensor 13 while the hot water is used. In this case, when it is confirmed that the temperature of the direct water or hot water, which is confirmed by the direct water temperature sensor 13 while the hot water is used, is a predetermined temperature or higher, the controller 100 stops the operation of the pump 14 to prevent unnecessary preheating.

An operation flow of the hot water supply apparatus according to the present disclosure as described above will be described in more detail as follows.

Figure 5:
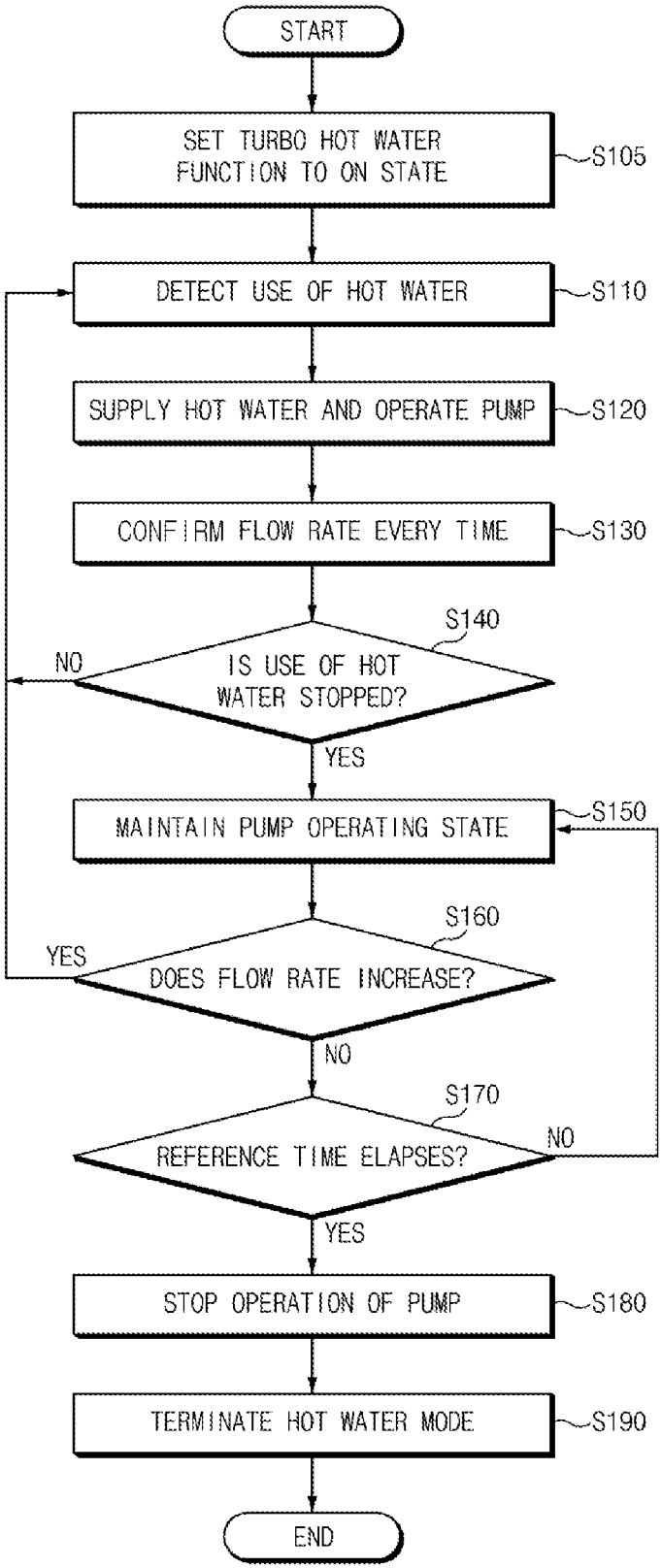
FIGS. 5, 6, and 7 are views illustrating operational flows of a method of controlling the hot water supply apparatus according to the embodiment of the present disclosure.
Figure 6:
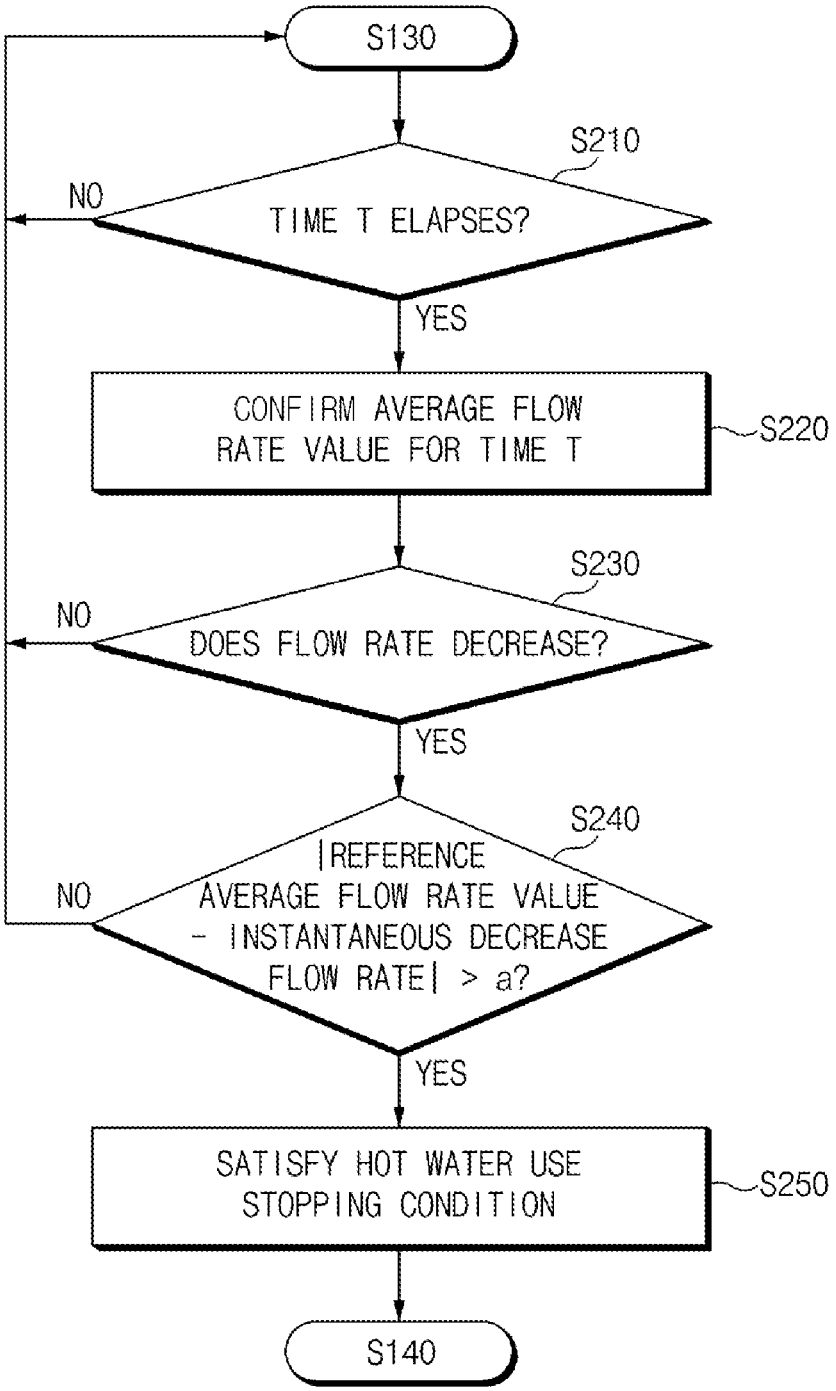
Figure 7:
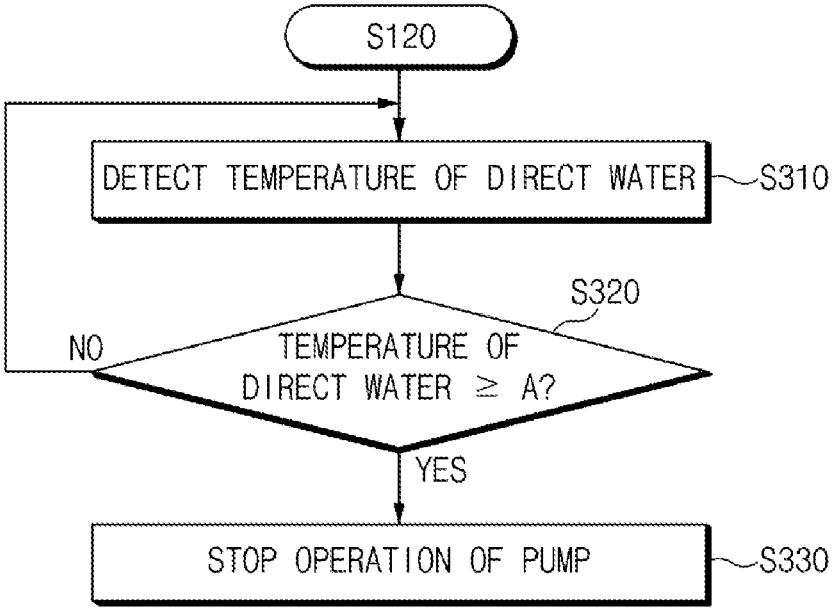

FIGS. 5, 6, and 7 are views illustrating operational flows of a method of controlling the hot water supply apparatus according to the embodiment of the present disclosure.

First, referring to FIG. 5, in a state in which the turbo hot water function is set to an ON state (S105), when the flow rate flowing through the direct water supply line increases to the first reference amount or more as the faucet is opened, the hot water supply apparatus 10 detects the use of the hot water (S110).

When the use of the hot water is detected, the hot water supply apparatus 10 supplies the hot water and operates the pump 14 (S120). In operation S120, the hot water supply apparatus 10 operates in the hot water mode, controls the heater and the heat exchanger 11, supplies the hot water through the hot water discharge line, operates in the turbo hot water mode when the supply of the hot water is maintained for a predetermined time or more, and operates the pump 14.

The hot water supply apparatus 10 confirms the value measured by the flow rate sensor 15 every time while the hot water is used in a pump operating state. Here, the hot water supply apparatus 10 confirms whether the flow rate confirmed by the flow rate sensor 15 decreases.

In this case, when it is confirmed that the flow rate flowing through the direct water supply line decreases by the second reference amount or more, the hot water supply apparatus 10 may determine that the use of the hot water is stopped. Accordingly, when it is confirmed that the use of the hot water is stopped (S140), the hot water supply apparatus 10 maintains the pump 14 for the circulation of the hot water in operation for a reference time to prevent a delay in a time at which the temperature of the hot water supplied when the hot water is reused reaches a target hot water temperature (S150).

When the flow rate confirmed through the flow rate sensor 15 does not increase to the first reference amount or more even when the reference time elapses after the use of the hot water is stopped (S160 and S170), the hot water supply apparatus 10 determines that the hot water is not reused, stops the operation of the pump 14 (S180), and terminates the hot water mode (S190).

Meanwhile, when it is confirmed that the flow rate confirmed by the flow rate sensor 15 before the reference time elapses after the use of the hot water is stopped increases to the first reference amount or more (S160), the controller 100 may perform a control to detect the reuse of the hot water and supply the hot water (S110 and S120).

Further, the controller 100 may confirm whether the hot water use stopping condition is satisfied while the hot water is used in a state in which the pump 14 is in operation. An embodiment therefor will refer to FIG. 6.

As in operation S130 of FIG. 5, the hot water supply apparatus 10 confirms whether the flow rate decreases while confirming the value measured by the flow rate sensor 15 every time while the hot water is used in the pump operating state.

Here, as illustrated in FIG. 6, the hot water supply apparatus 10 confirms an average flow rate value for the flow rate detected by the flow rate sensor 15 during time "T" whenever time "T" elapses (S210 and S220). As an example, the hot water supply apparatus 10 may confirm the average flow rate value every two seconds.

When it is confirmed from the flow rate sensor 15 that, in a process of detecting the flow rate every time, the flow rate decreases (S230), the hot water supply apparatus 10 compares the instantaneous decrease flow rate at a corresponding time point with the reference average flow rate value. Here, the reference average flow rate value may be defined as a larger value of two recently confirmed average flow rate values based on a time point when the instantaneous decrease flow rate is confirmed.

When a difference value between the instantaneous decrease flow rate confirmed by the flow rate sensor 15 and the reference average flow rate value is greater than or equal to a preset reference value (S240), the hot water supply apparatus 10 determines that the hot water use stopping condition is satisfied (S250).

Accordingly, when it is confirmed in operation S250 that the hot water use stopping condition is satisfied, the hot water supply apparatus 10 determines that the use of the hot water is stopped in operation S140 of FIG. 5 and performs subsequent processes.

Meanwhile, as illustrated in FIG. 7, the hot water supply apparatus 10 may detect the temperature of the direct water (or the hot water) flowing through the direct water supply line from the direct water temperature sensor 13 while the hot water is used in a state in which the pump 14 is in operation (S310). When the temperature of the direct water (or the hot water) detected in operation S310 is greater than or equal to a predetermined temperature "A" (S320), the operation of the pump 14 is stopped to prevent unnecessary preheating (S330).

As described above, in the hot water supply apparatus 10 and the method of controlling the same according to the embodiment of the present disclosure, when the supply of the hot water is stopped while the hot water is supplied, the operation of the pump is not immediately stopped, the pump operating state is maintained for a reference time, and thus when the hot water is resupplied, a time for which the temperature of the hot water reaches the target hot water temperature due to a decrease in the temperature of the hot water may be minimized. When the flow rate of the hot water discharge line is confirmed in real time and the flow rate of the hot water does not increase even when the reference time elapses, the operation of the pump 14 is stopped, and thus unnecessary preheating operations may be prevented from continuing.

According to an embodiment of the present disclosure, when use of hot water is stopped in a state in which a hot water supply apparatus is set to a turbo hot water function, operation of a pump is not immediately stopped, a pump operating state is maintained during a reference time, and thus when the hot water is reused within the reference time, a temperature of the existing hot water is maintained.

Further, according to an embodiment of the present disclosure, a flow rate of a direct water supply line is confirmed in real time while the hot water is used in a state in which the hot water supply apparatus is set to the turbo hot water function, and when a difference between an instantaneous decrease flow rate of the direct water supply line and a reference average flow rate value is greater than or equal to a reference value, it is determined that the use of the hot water is stopped, and thus unnecessary preheating is prevented from continuing.

The above description is merely illustrative of the technical spirit of the present disclosure, and those skilled in the art to which the present disclosure belongs may make various modifications and changes without departing from the essential features of the present disclosure.

Thus, the embodiments disclosed in the present disclosure are not intended to limit the technology spirit of the present disclosure, but are intended to describe the present disclosure, and the scope of the technical spirit of the present disclosure is not limited by these embodiments. The scope of protection of the present disclosure should be interpreted by the appended claims, and all technical spirits within the scope equivalent thereto should be interpreted as being included in the scope of the present disclosure.

What is claimed is:

1. A hot water supply apparatus comprising:

a pump configured to apply a pressure to a direct water supply line connected to a heat exchanger to supply direct water or hot water to the heat exchanger;

a flow rate sensor configured to measure a flow rate of the direct water or the hot water flowing through the direct water supply line; and a controller configured to maintain an operating state of the pump during a reference time and confirm a change in a flow rate of the direct water supply line through the flow rate sensor, to adjust or stop operation of the pump according to the detected flow rate when use of the hot water is stopped in a state in which the pump is in operation, wherein the controller monitors the flow rate measured by the flow rate sensor in real-time while the hot water is used in a state in which the pump is in operation and determines whether a hot water use stopping condition is satisfied, and wherein the controller compares an instantaneous decrease flow rate confirmed through the flow rate sensor with a reference average flow rate value and determines that the hot water use stopping condition is satisfied when a difference value therebetween is greater than or equal to a preset reference value.

2. The hot water supply apparatus of claim 1, wherein the controller determines that the use of the hot water is stopped when the flow rate confirmed through the flow rate sensor decreases by a preset reference amount or more.

3. The hot water supply apparatus of claim 1, wherein the controller confirms an average flow rate value for previous time T whenever time T elapses and defines, as the reference average flow rate value, a larger value of two recently confirmed average flow rate values based on a time point at which the instantaneous decrease flow rate is confirmed.

4. The hot water supply apparatus of claim 1, wherein the controller stops the operation of the pump when the flow rate confirmed through the flow rate sensor does not increase to a preset reference amount or more during the reference time after the use of the hot water is stopped.

5. The hot water supply apparatus of claim 1, wherein the controller determines that the hot water supply apparatus is in a hot water reuse state when the flow rate confirmed through the flow rate sensor increases to a preset reference amount or more before the reference time elapses after the use of the hot water is stopped.

6. The hot water supply apparatus of claim 1, further comprising:

a direct water temperature sensor disposed in the direct water supply line and configured to measure a temperature of the direct water or the hot water flowing through the direct water supply line.

7. The hot water supply apparatus of claim 6, wherein the controller stops the operation of the pump when it is confirmed that the temperature of the direct water or the hot water confirmed by the direct water temperature sensor is greater than or equal to a predetermined temperature.

8. The hot water supply apparatus of claim 1, wherein the controller operates the hot water supply apparatus in a turbo hot water mode when the flow rate confirmed by the flow rate sensor increases to a preset reference amount or more in a state in which a turbo hot water function is set to an ON state.

9. A method of controlling a hot water supply apparatus, the method comprising:

applying, by a pump, a pressure to a direct water supply line connected to a heat exchanger to supply direct water or hot water to the heat exchanger;

measuring, by a flow rate sensor, a flow rate of the direct water or the hot water flowing through the direct water supply line; and confirming a change in the flow rate of the direct water supply line through the flow rate sensor while an operating state of the pump is maintained during a reference time, adjusting or stopping operation of the pump according to the detected flow rate when use of the hot water is stopped in a state in which the pump is in operation, further comprising:

monitoring the flow rate measured by the flow rate sensor in real-time until the reference time elapses while the hot water is used in a state in which the pump is in operation; and determining whether a hot water use stopping condition is satisfied based on the flow rate confirmed from the flow rate sensor, wherein the determining of whether the hot water use stopping condition is satisfied includes:

confirming an average flow rate value for previous time T whenever time T elapses;

defining, as a reference average flow rate value, a larger value of two recently confirmed average flow rate values based on a time point at which an instantaneous decrease flow rate is confirmed when the flow rate decreases; and comparing the instantaneous decrease flow rate with the reference average flow rate value and determining that the hot water use stopping condition is satisfied when a difference value therebetween is greater than or equal to a preset reference value.

10. The method of claim 9, wherein the confirming of the change in the flow rate includes determining that the use of the hot water is stopped when the flow rate confirmed through the flow rate sensor decreases by a preset reference amount or more.

11. The method of claim 9, further comprising:

stopping the operation of the pump when the flow rate confirmed through the flow rate sensor does not increase to a preset reference amount or more during the reference time after the use of the hot water is stopped.

12. The method of claim 9, further comprising:

determining that the hot water supply apparatus is in a hot water reuse state when the flow rate confirmed through the flow rate sensor increases to a preset reference amount or more before the reference time elapses after the use of the hot water is stopped.

13. The method of claim 9, further comprising:

measuring a temperature of the direct water or the hot water flowing through the direct water supply line using a direct water temperature sensor disposed in the direct water supply line.

14. The method of claim 13, further comprising:

stopping the operation of the pump when it is confirmed that the temperature of the direct water or the hot water confirmed by the direct water temperature sensor is greater than or equal to a predetermined temperature.

15. The method of claim 9, further comprising:

operating the hot water supply apparatus in a turbo hot water mode when the flow rate confirmed by the flow rate sensor increases to a preset reference amount or more in a state in which a turbo hot water function is set to an ON state.

* * * * *